US009089008B2

(12) United States Patent
Feng et al.

(10) Patent No.: US 9,089,008 B2
(45) Date of Patent: Jul. 21, 2015

(54) HEATERS

(71) Applicants: Tsinghua University, Beijing (CN); HON HAI PRECISION INDUSTRY CO., LTD., New Taipei (TW)

(72) Inventors: Chen Feng, Beijing (CN); Xue-Wei Guo, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 77 days.

(21) Appl. No.: 13/901,572

(22) Filed: May 24, 2013

(65) Prior Publication Data

US 2014/0175087 A1 Jun. 26, 2014

(30) Foreign Application Priority Data

Dec. 22, 2012 (CN) ..... 2012 1 05616491

(51) Int. Cl.
*H05B 1/02* (2006.01)
*H05B 3/14* (2006.01)

(52) U.S. Cl.
CPC ..... *H05B 3/145* (2013.01); *H05B 1/0238* (2013.01); *H05B 2203/029* (2013.01); *H05B 2214/04* (2013.01)

(58) Field of Classification Search
CPC .... H05B 3/12; H05B 3/145; H05B 2203/029; H05B 2214/04; H05B 3/16; H05B 3/36; H05B 3/44; H05B 1/0238
USPC ..... 219/504, 505, 494, 543, 544, 549, 553
See application file for complete search history.

(56) References Cited

U.S. PATENT DOCUMENTS

| | | | | |
|---|---|---|---|---|
| 4,482,801 | A * | 11/1984 | Habata et al. | 219/540 |
| 8,653,497 | B2 * | 2/2014 | Tran | 257/5 |
| 2004/0113127 | A1 * | 6/2004 | Min et al. | 252/500 |
| 2005/0040371 | A1 * | 2/2005 | Watanabe et al. | 252/500 |
| 2006/0113510 | A1 * | 6/2006 | Luo et al. | 252/500 |
| 2008/0023327 | A1 * | 1/2008 | Douglas | 204/403.14 |
| 2008/0223841 | A1 * | 9/2008 | Lofy | 219/202 |
| 2010/0053931 | A1 * | 3/2010 | Carroll et al. | 362/84 |
| 2010/0221517 | A1 * | 9/2010 | Swift et al. | 428/220 |
| 2012/0114401 | A1 * | 5/2012 | Kagawa | 399/333 |

* cited by examiner

*Primary Examiner* — Mark Paschall
(74) *Attorney, Agent, or Firm* — Novak Druce Connolly Bove + Quigg LLP

(57) ABSTRACT

A heater includes a heating element, a first electrode, a second electrode and a temperature controller. The heating element includes carbon nanotube layer and a binder. The carbon nanotube layer defines a number of wrinkles. The temperature controller is electrically connected to the heating element by the first electrode or the second electrode. The temperature controller is capable of controlling a temperature of the heating element by controlling a voltage and electric current applied to the heating element.

18 Claims, 5 Drawing Sheets

HEATERS

CROSS-REFERENCE TO RELATED APPLICATION

This application claims all benefits accruing under 35 U.S.C. §119 from China Patent Application No. 201210561649.1, filed on Dec. 22, 2012, in the China Intellectual Property Office, the contents of which are hereby incorporated by reference.

BACKGROUND

1. Technical Field

The present disclosure relates to a heater.

2. Description of Related Art

Heaters are widely used in different fields such as a vehicle seat, a heating blanket, and a heating care belt. An electric resistance wire is commonly used as a heating element. Material of the electric resistance wire is usually metals or alloy of low tensile strength and low bending resistance. As a result, electric shocks can be caused by a breakage of the electric resistance wire. Therefore, a lifespan of the heater may be relatively short.

What is needed, therefore, is to provide a heater having a high tensile strength and a high bending resistance property.

BRIEF DESCRIPTION OF THE DRAWING

Many aspects of the present disclosure can be better understood with reference to the following drawings. The components in the drawings are not necessarily to scale, the emphasis instead being placed upon clearly illustrating the principles of the present embodiments.

DETAILED DESCRIPTION

The disclosure is illustrated by way of example and not by way of limitation in the figures of the accompanying drawings in which like references indicate similar elements. It should be noted that references to "another," "an," or "one" embodiment in this disclosure are not necessarily to the same embodiment, and such references mean at least one.

Figure 1:
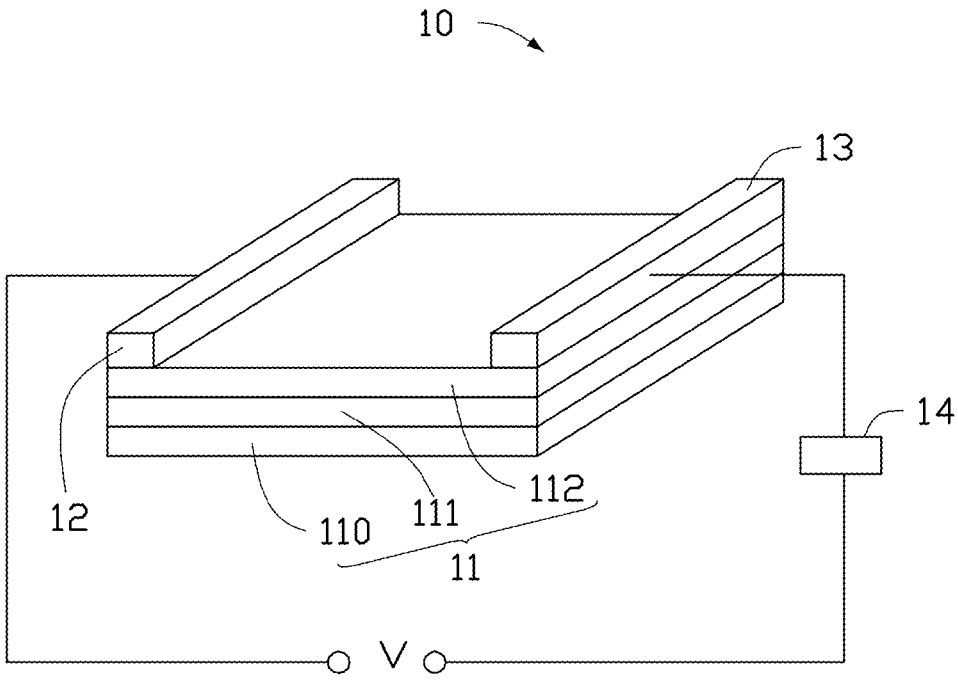
FIG. 1 shows a schematic structural view of one embodiment of a heater.

FIG. 1 shows an embodiment of a heater. The heater 10 includes a temperature controller 14, a heating element 11, a first electrode 12 and a second electrode 13. The first electrode 12 and the second electrode 13 are spaced from each other and are electrically connected to the heating element 11. The temperature controller 14 is electrically connected to heating element 11 by the first electrode 12 or the second electrode 13. The temperature controller 14 can be used to sense and control a temperature T of the heating element 11.

The heating element 11 includes a flexible substrate 110, a binder 111 and a carbon nanotube layer 112. The carbon nanotube layer 112 is fixed on a surface of the flexible substrate 110 with the binder 111. The first electrode 12 and the second electrode 13 are fixed on two ends of the carbon nanotube layer 112 and are electrically connected to the carbon nanotube layer 112.

A material of the flexible substrate 110 can be a flexible insulating material having an excellent ductility and a high strength, such as silicon rubber, polyvinylchloride, polytetrafluoroethene, non woven fabric, polyurethane (PU), or leather. In one embodiment, the flexible substrate 110 is a rectangle shaped PU substrate. In one embodiment, the binder 111 is a silica gel layer.

The carbon nanotube layer 112 is adhered to the surface of the flexible substrate 110 with the binder 111. The binder 111 is infiltrated into the carbon nanotube layer 112 to combine the carbon nanotube layer 112 and the flexible substrate 110 firmly. Furthermore, because the binder 111 is infiltrated between the adjacent carbon nanotubes in the carbon nanotube layer 112 to form a composite structure, the heating element 11 can have a good negative temperature coefficient κ, for example, smaller than −0.0050.

Figure 2:
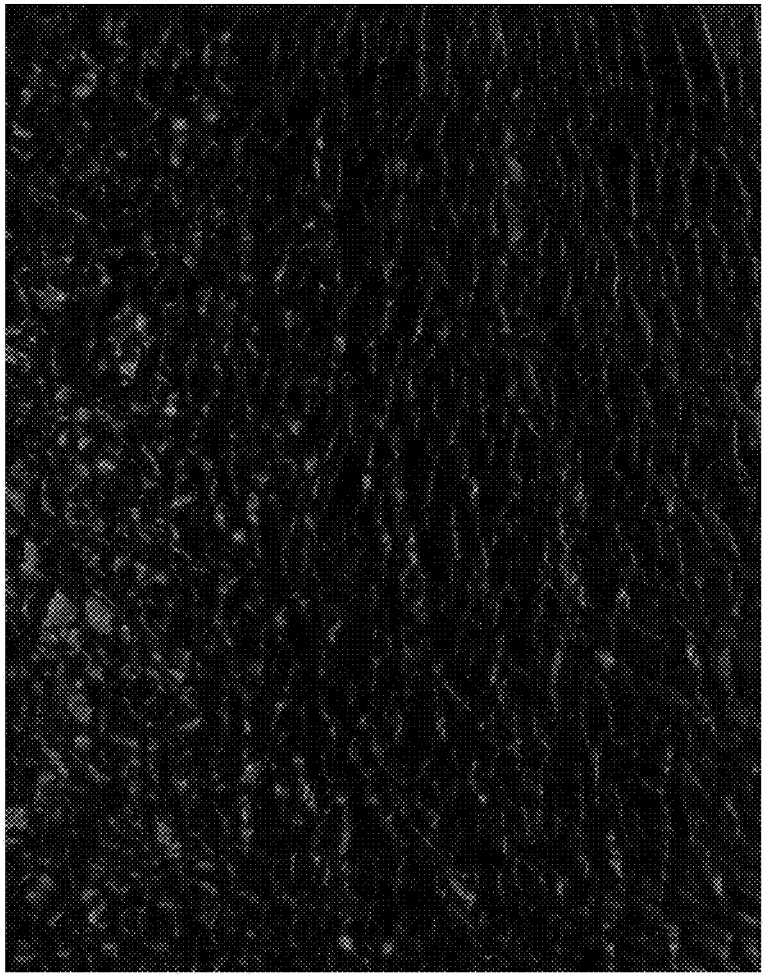
FIG. 2 is a photo of a carbon nanotube layer in the heater of FIG. 1.
Figure 3:
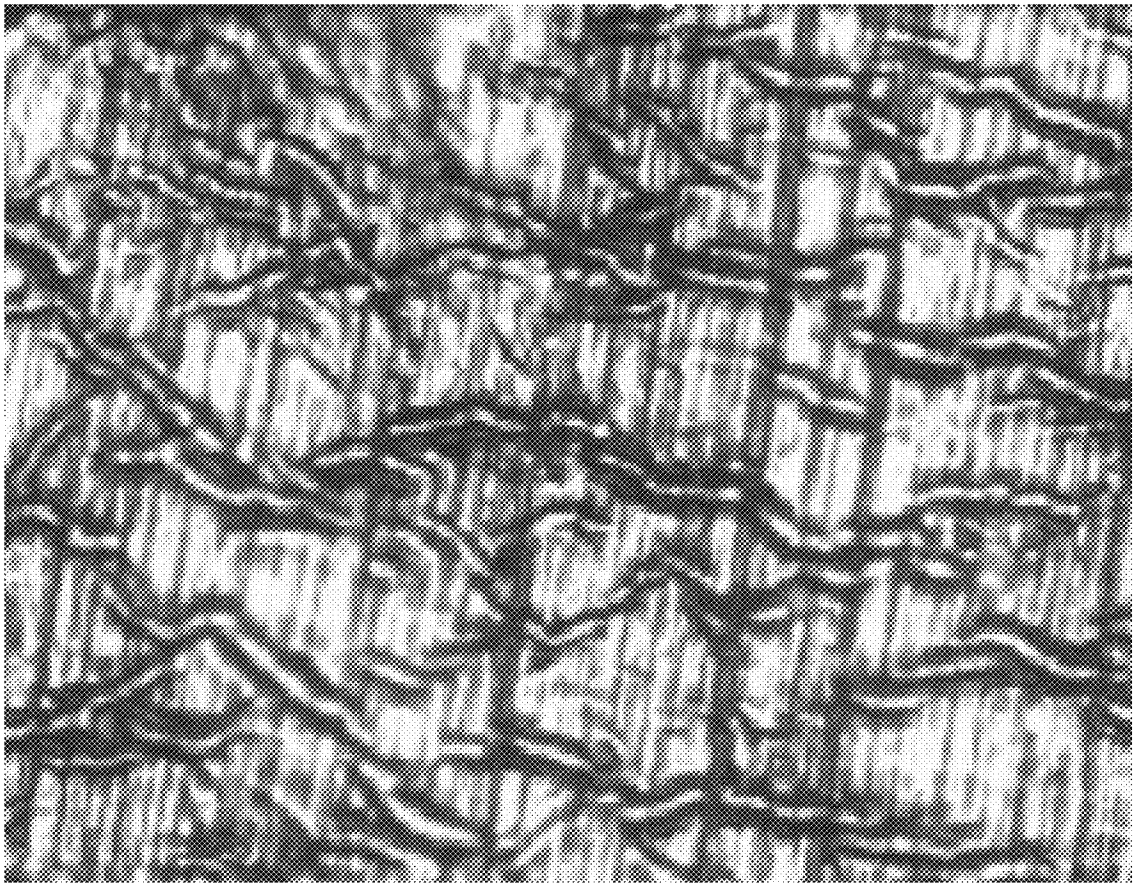
FIG. 3 is an optical microscopic image of the carbon nanotube layer of FIG. 2.

The carbon nanotube layer 112 comprises of a number of carbon nanotubes. The carbon nanotube layer 112 can also consist solely or comprise essentially of a number of carbon nanotubes. Referring to FIGS. 2 and 3, the carbon nanotubes in the carbon nanotube layer 112 bend along a direction substantially perpendicular to the surface of the flexible substrate 110 and form a number of wave shaped protuberances. Namely, some portions of the carbon nanotubes are higher than other portions of the carbon nanotubes. Macroscopically, the carbon nanotube layer 112 includes a number of wrinkles formed by the wave shaped protuberances of the carbon nanotubes. An extending direction of the wrinkles can be crossed with an extending direction of the carbon nanotubes in the carbon nanotube layer 112. Referring to FIG. 3, in one embodiment, the extending direction of the wrinkles is substantially perpendicular to the extending direction of the carbon nanotubes. Thus, the heating element 11 has a drawing margin in the extending direction of the carbon nanotubes.

The flexible substrate 110 is flexible, and the heating element 11 has the drawing margin in the extending direction of the carbon nanotubes. If the heating element 11 is drawn along the extending direction of the carbon nanotubes, the carbon nanotubes in the carbon nanotube layer 112 does not break easily.

The method for forming the heating element 11 includes the steps of: applying an external force on the rectangle shaped PU substrate, whereby a 10% deformation of the PU can be induced by the drawing; forming the silica gel layer by coating a silica gel on a surface of the deformed PU; forming a carbon nanotube prefabricated structure by disposing a number of carbon nanotube films stacked with each other on the silica gel layer; and forming the carbon nanotube layer by removing the external force applied on the deformed PU. The deformed PU is shrunk after the external force is removed. The carbon nanotube prefabricated structure is also shrunk with the shrinkage of the deformed PU to form the carbon nanotube layer 112. The carbon nanotubes in the carbon nanotube layer 112 are bent into the protuberances substantially perpendicular to the surface of the PU. In some embodiments, a step of removing the PU can be carried out after the carbon nanotube layer 112 is formed.

Figure 4:
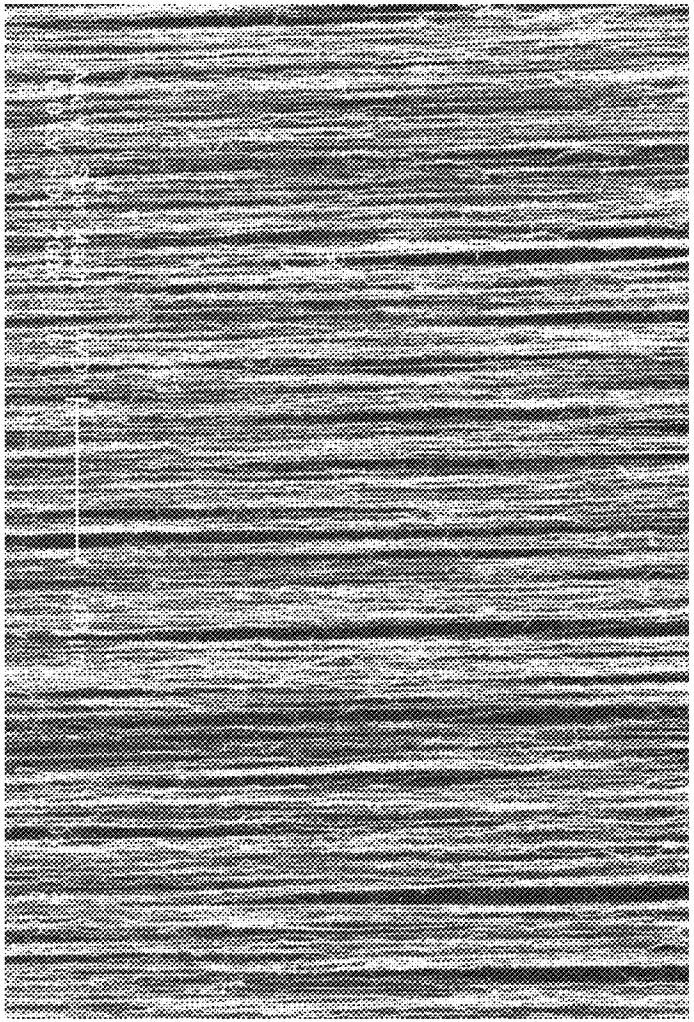
FIG. 4 is a scanning electron microscopic image of a carbon nanotube film in the heater of FIG. 1.

Referring to FIG. 4, the carbon nanotube film is a free-standing structure. A large number of the carbon nanotubes in the carbon nanotube film can be oriented along a preferred orientation, meaning that a large number of the carbon nanotubes in the carbon nanotube film are arranged substantially along the same direction. The arranged orientations of a large number of the carbon nanotubes are substantially parallel to the surface of the carbon nanotube film. An end of one carbon nanotube is joined to another end of an adjacent carbon nanotube arranged substantially along the same direction by van der Waals attractive force. A small number of the carbon nanotubes are randomly arranged in the carbon nanotube film, and has a small if not negligible effect on the larger number of the carbon nanotubes in the carbon nanotube film arranged substantially along the same direction. The carbon nanotube film is capable of forming a free-standing structure. The term "free-standing structure" can be defined as a structure that does not have to be supported by a substrate. For example, a free-standing structure can sustain the weight of itself when it is hoisted by a portion thereof without any significant damage to its structural integrity. So, if the carbon nanotube film is placed between two separate supporters, a portion of the carbon nanotube film, not in contact with the two supporters, would be suspended between the two supporters and yet maintain film structural integrity. The free-standing structure of the carbon nanotube film comprises the successive carbon nanotubes joined end to end by van der Waals attractive force. Microscopically, the carbon nanotubes oriented substantially along the same direction may not be perfectly aligned in a straight line, and some curve portions may exist. Some carbon nanotubes located substantially side by side and oriented along the same direction in contact with each other cannot be excluded. Specifically, the carbon nanotube film includes a plurality of successively oriented carbon nanotube segments joined end-to-end by van der Waals attractive force therebetween. Each carbon nanotube segment includes a plurality of carbon nanotubes substantially parallel to each other, and joined by van der Waals attractive force therebetween. The carbon nanotube segments can vary in width, thickness, uniformity, and shape. The carbon nanotubes in the carbon nanotube film are also substantially oriented along a preferred orientation.

In one embodiment, 200 layers of the carbon nanotube film are stacked on the surface of the on the silica gel layer, and the oriented direction of the carbon nanotubes in the adjacent carbon nanotube films are paralleled with each other.

The first electrode 12 and the second electrode 13 are two strip shaped electrodes paralleled with each other. The first electrode 12 and the second electrode 13 are located on the two ends of the carbon nanotube layer 112. The carbon nanotubes of the heating element 11 are oriented from the first electrode 12 to the second electrode 13 and joined end by end by van der Waals attractive force. That is, the oriented direction of the carbon nanotubes of the heating element 11 is substantially perpendicular to the first electrode 12 and the second electrode 13. An angle $\alpha$ between the oriented direction of the carbon nanotubes of the heating element 11 and the first electrode 12 and the second electrode 13 can be in a range from about 0 degrees to about 90 degrees.

Figure 5:
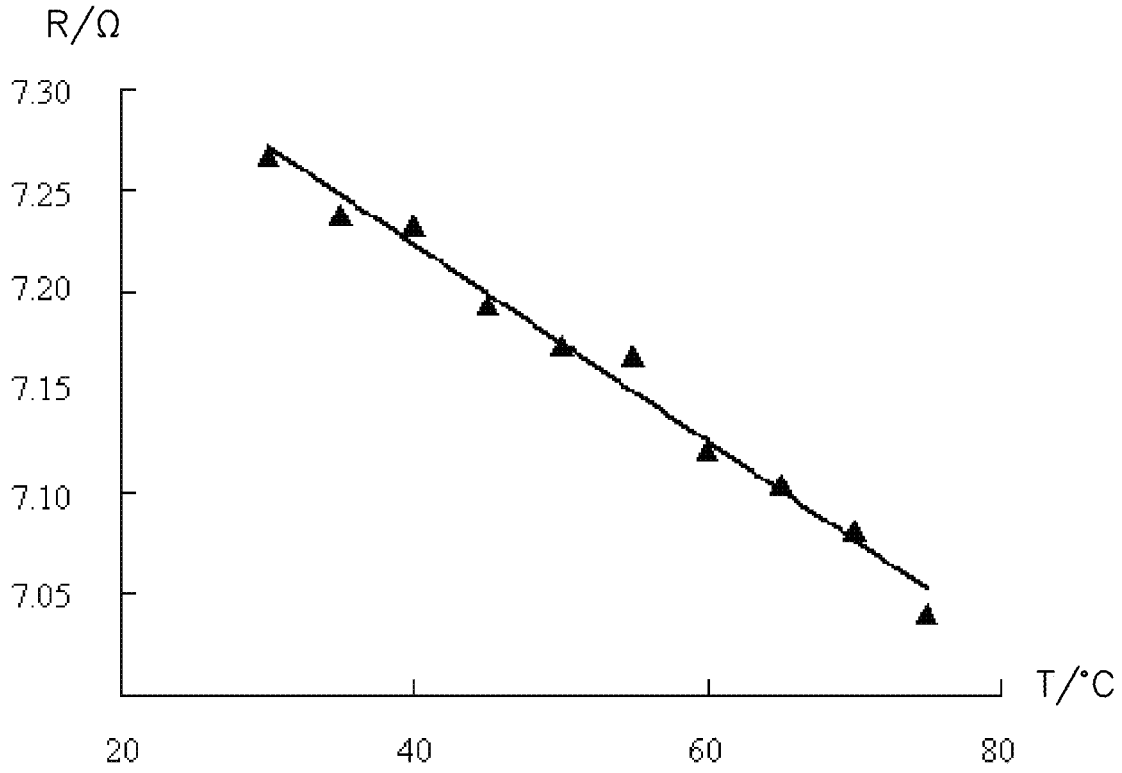
FIG. 5 shows a temperature-resistance curve of a heating element in the heater of FIG. 1.

The temperature controller 14 can be used to control the temperature of the heating element 11 by controlling a voltage U and an electric current I applied to the heating element 11. The temperature controller 14 can be a power regulator or a rheostat. In one embodiment, the temperature controller 14 is a power regulator. In the embodiment, a predetermined voltage U and a predetermined electric current I can be applied to the heating element 11 by the temperature controller 14 to obtain a resistance R of the heating element 11 by a formula: $R=U/I$. The temperature T of the heating element 11 can be further obtained by the resistance R of the heating element 11. The temperature T and the resistance R of the heating element 11 satisfy the formula: $R=\kappa T+A=U/I$, wherein A is a constant which can be obtained by measuring the heating element 11, and the negative temperature coefficient $\kappa$ is smaller than $-0.0050$. Thus, the temperature T of the heating element 11 can be obtained by the formula: $T=(U/I-A)/\kappa$. Referring to FIG. 5, in one embodiment, the negative temperature coefficient $\kappa$ of the heating element 11 is about $-0.0051$, and A is about 7.428, thus the temperature T of the heating element 11 satisfies the formula: $T=-(U/I-7.428)/0.0051$.

This heater has many advantages. Comparing with a traditional heater, the heating element can reach a predetermined temperature by controlling a voltage and an electric current applied to the heating element without using a thermocouple. Thus, the heater has a simple structure and low cost. Second, the temperature of the heating element measured by the temperature controller is a bulk temperature of the heating element, rather than a partial temperature of the heating element. Thus, the heater can achieve accurate temperature control. Third, the heating element has a drawing margin in the extending direction of the carbon nanotubes. Thus, the heating element has a high tensile strength, a high bending resistance performance, and a high mechanical strength.

It is to be understood the above-described embodiment is intended to illustrate rather than limit the disclosure. Variations may be made to the embodiment without departing from the spirit of the disclosure as claimed. The above-described embodiments are intended to illustrate the scope of the disclosure and not restricted to the scope of the disclosure.

What is claimed is:

1. A heater comprising:

a heating element having a negative temperature coefficient $\kappa$ and comprising a carbon nanotube layer and a binder layer attached directly to the carbon nanotube layer, the carbon nanotube layer defining a plurality of wrinkles, wherein the carbon nanotube layer comprises a plurality of carbon nanotubes extending substantially along a same direction;

a first electrode and a second electrode located on two ends of the carbon nanotube layer; and a temperature controller electrically connected to the heating element via the first electrode or the second electrode;

wherein the temperature controller controls a temperature of the heating element by controlling a voltage and an electric current applied to the heating element; the temperature of the heating element satisfies a formula: $T=(U/I-A)/\kappa$, wherein T is the temperature of the heating element, U is voltage, I is the electric current, and A is a constant.

2. The heater of claim 1, wherein the carbon nanotube layer comprises a plurality of carbon nanotube films stacked with each other, each the carbon nanotube film comprises carbon nanotubes arranged substantially along a same direction.

3. The heater of claim 1, wherein the carbon nanotube layer comprises a plurality of carbon nanotubes extending from the first electrode to the second electrode.

4. The heater of claim 3, wherein the plurality of carbon nanotubes in the carbon nanotube layer are joined end to end along the extending direction.

5. The heater of claim 4, wherein the plurality of wrinkles are protuberances formed by bending the plurality of carbon nanotubes.

6. The heater of claim 5, wherein an extending direction of the wrinkles intersects an extending direction of the plurality of carbon nanotubes of the carbon nanotube layer.

7. The heater of claim 6, wherein the extending direction of the wrinkles is substantially perpendicular with the extending direction of the plurality of carbon nanotubes of the carbon nanotube layer.

8. The heater of claim 1, wherein the binder layer is infiltrated into the carbon nanotube layer.

9. The heater of claim 1, wherein the negative temperature coefficient κ is equal to or less than about −0.0050.

10. The heater of claim 1, wherein the negative temperature coefficient κ is about −0.0051, A is about 7.428, and the temperature satisfying a formula: $T=-(U/I-7.428)/0.0051$.

11. The heater of claim 1, further comprising a flexible substrate, and the carbon nanotube layer is fixed on a surface of the flexible substrate with the binder layer.

12. The heater of claim 11, wherein a material of the flexible substrate is selected from the group consisting of silicon rubber, polyvinylchloride, polytetrafluoroethene, nonwoven fabric, polyurethane, leather, and any combination thereof.

13. The heater of claim 1, wherein the temperature controller is a power regulator or a rheostat.

14. A heater comprising:

a heating element having a negative temperature coefficient κ, wherein the heating element comprises a plurality of carbon nanotubes extending substantially along a same direction;

a first electrode and a second electrode located on two opposite ends of the heating element; and a temperature controller electrically connected to the heating element through the first electrode or the second electrode;

wherein the temperature controller is capable of controlling a temperature of the heating element by controlling a voltage and an electric current applied to the heating element; the temperature of the heating element satisfies a formula: $T=(U/I-A)/\kappa$, wherein T is the temperature of the heating element, U is voltage, I is the electric current, and A is a constant.

15. The heater of claim 14, wherein the temperature controller is a power regulator or a rheostat.

16. The heater of claim 14, wherein the heating element comprises a carbon nanotube layer, a silica gel layer and a flexible substrate; the carbon nanotube layer is fixed on a surface of the flexible substrate with the silica gel layer.

17. The heater of claim 16, wherein the carbon nanotube layer consists of the plurality of carbon nanotubes, and the plurality of carbon nanotubes are joined end to end along the extending direction of the plurality of carbon nanotubes.

18. The heater of claim 17, wherein the plurality of carbon nanotubes bend along a direction substantially perpendicular to the surface of the flexible substrate, and form a plurality of wave shaped protuberances.

* * * * *